United States Patent [19]

Brower, Jr. et al.

[11] 4,158,619

[45] Jun. 19, 1979

[54] METHOD AND APPARATUS FOR REMOVING EXCESS ELECTRO-PHORETIC MATERIAL FROM A COATED INTERIOR WORKPIECE SURFACE

[75] Inventors: Loyd R. Brower, Jr., Olympia Fields; Leonard P. Madsen, St. Anne; Chesley L. Zutaut, Park Forest, all of Ill.

[73] Assignee: Standard T Chemical Company, Inc., Chicago, Ill.

[21] Appl. No.: 878,682

[22] Filed: Feb. 17, 1978

Related U.S. Application Data

[63] Continuation-in-part of Ser. No. 807,965, Jun. 20, 1977, Pat. No. 4,107,016, which is a continuation of Ser. No. 686,110, Jun. 7, 1976, abandoned, which is a continuation-in-part of Ser. No. 597,314, Jul. 21, 1975, abandoned.

[51] Int. Cl.[2] ..... C25D 13/14

[52] U.S. Cl. ..... 204/181 R; 204/181 C; 204/300 EC

[58] Field of Search ..... 204/181 R, 300 EC

[56] References Cited

U.S. PATENT DOCUMENTS

| | | | |
|---|---|---|---|
| 3,620,952 | 11/1971 | Chiappe | 204/300 EC |
| 3,971,708 | 7/1976 | Davis et al. | 204/181 R |

*Primary Examiner*—Howard S. Williams
*Attorney, Agent, or Firm*—Carpenter & Ostis

[57] ABSTRACT

Improved method and apparatus for removing excess electrophoretic material from a coated interior workpiece surface wherein a flow of air is passed over the entirety of the electrophoretic coating to remove such excess electrophoretic material therefrom.

17 Claims, 13 Drawing Figures

METHOD AND APPARATUS FOR REMOVING EXCESS ELECTRO-PHORETIC MATERIAL FROM A COATED INTERIOR WORKPIECE SURFACE

BACKGROUND OF THE INVENTION

The present application is a continuation-in-part of copending application Ser. No. 807,965, filed on June 20, 1977, now U.S. Pat. No. 4,107,016; which is a continuation of abandoned application Ser. No. 686,110, filed on June 7, 1976; which is in turn a continuation-in-part of abandoned application Ser. No. 597,314, filed on July 21, 1975.

The present invention relates generally to electrophoresis and more particularly to an improved method for removing excess electrophoretic material from an interior coated surface of a workpiece by means of a flow of air.

After a workpiece has been electrophoretically coated, it is necessary to remove the excess electrophoretic material from such coating to provide an uniform surface and to avoid waste of the electrophoretic material. Prior art techniques have been largely directed to submerging the workpiece in a tank of water to rinse away such excess. Although it has been possible to recover the then very diluted electrophoretic material from the rinse tank and to reconstitute such diluted electrophoretic material into a useable titer in order to avoid waste, such techniques have not been without difficulty and disadvantage. For example, additional equipment has been necessary. The bath itself is expensive both in capital outlay and in maintenance costs. Additional filtering equipment has been necessary. Additional workpiece handling equipment to and from the bath has been necessary. Environmental problems associated with waste water have been created. Also, the step of rinsing requires a period of time to accomplish which slows down the production of coated workpieces. The above factors in combination make for a rinse system which is less than optimal in production efficiency and in speed of operation, in initial cost and cost of operation, in environmental considerations, and in conservation of the electrophoretic material.

Accordingly, in view of the above difficulties associated with prior art techniques, it is an object of the improved method and apparatus of the present invention to provide means for directing a flow of air over substantially the entirety of a coated interior surface of a workpiece to remove excess electrophoretic material therefrom.

It is a further object of the improved method and apparatus of the present invention to provide relative movement between the flow of air and the workpiece about an axis fixed relative to the flow of air and the workpiece to pass the stream of air over substantially the entirety of the workpiece surface.

It is a yet further object of the improved method and apparatus of the present invention is to provide means for confining the flow of air passing over such coated interior surface to the proximate surface of such coating.

It is another object of the improved method and apparatus of the present invention to provide a nozzle which may be introduced into a workpiece for application of electrophoretic material to the interior surface thereof during such introduction and for application of a flow of air to the coated surface to remove excess electrophoretic material therefrom during withdrawal of the nozzle from the workpiece.

These and other objects and advantages of the improved method and apparatus of the present invention will become readily apparent to one skilled in the art upon review of the drawing and description contained hereinafter.

SUMMARY OF THE PRESENT INVENTION

The improved method and apparatus of the present invention broadly include means for providing a flow of air to an interior surface of a workpiece which has been electrophoretically coated for removing excess electrophoretic material therefrom. The improved method and apparatus of the present invention are particularly suited for use in connection with an electrophoretic coating system which provides a charged linear stream of electrophoretic coating to a selected linear dimension of the oppositely charged workpiece interior surface and preferably relative motion between such charged linear stream and the workpiece about an axis corresponding to the longitudinal axis of the workpiece to deposit a coating of the electrophoretic material over the entirety of the workpiece interior surface. In a preferred embodiment, means for providing the linear stream of electrophoretic material to the workpiece surface and means for providing the flow of air are disposed for simultaneous introduction thereof into the interior of a workpiece to provide the linear stream of electrophoretic material during such introduction and to provide the flow of air onto the coated surface during withdrawal.

The flow of air may be directed initially onto the closed end of a workpiece to flow thereafter toward the open end of the workpiece over the entirety of the coated surface. Alternatively, at least a portion of the air may flow initially onto the body portion of the workpiece near the closed end thereof.

The means for providing the flow of air is preferably carried by the nozzle utilized for supplying the electrophoretic material, with the flow of air issuing forth from the distal end portion of the nozzle through an aperture therein. Alternatively, a plurality of openings may be provided near the distal end of the nozzle for simultaneously directing several flows of air radially with respect to the longitudinal axis of the workpiece onto the body portion of the workpiece. In a further alternative embodiment, an electrically insulative annular tube is disposed near the distal end of the nozzle, is slightly smaller in diameter than the workpiece, and has airflow openings therein for directing air onto the coated interior surface during withdrawal of the nozzle. In a yet further alternative embodiment, an electrically insulative air barrier having a diameter slightly smaller than that of the workpiece is disposed near the distal end portion of the nozzle for channeling the flow of air proximate to the surface of the coating for removing excess electrophoretic material therefrom during withdrawal of the nozzle from the workpiece.

DETAILED DESCRIPTION OF THE PREFERRED EMBODIMENTS

Figure 1:
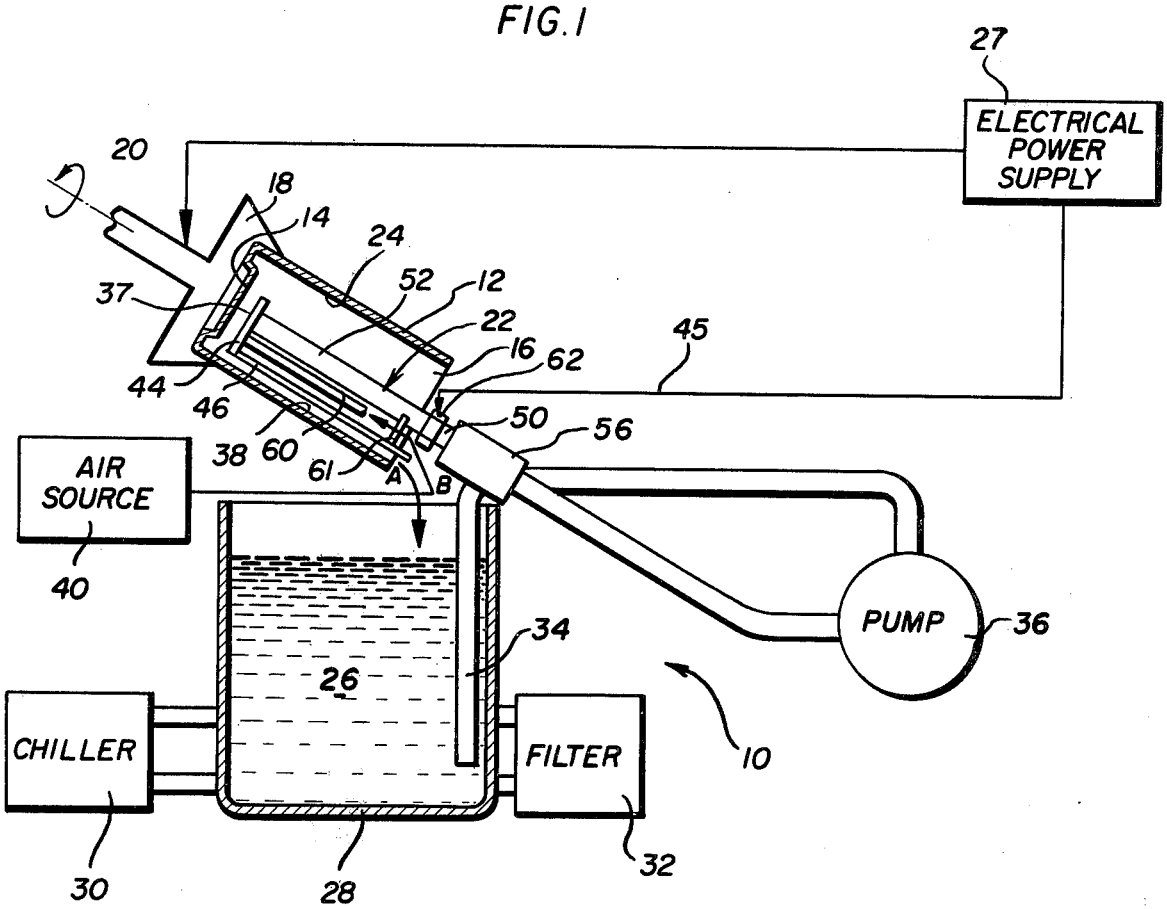
FIG. 1 is a schematic side view of the apparatus for carrying out the improved method of the present invention, showing a charged workpiece mounted by means of a mandrel over a coating bath provided with chiller and filter, a nozzle charged oppositely to the workpiece and inserted within the workpiece for coating the interior surface thereof with electrophoretic material, electrophoretic material supplied from the coating bath by means of a pump, and an air supply provided to the nozzle for removing excess electrophoretic material from the coated interior workpiece.

The improved method of the present invention is directed to providing a flow of air over the entirety of the interior surface of an electrophoretically coated workpiece to remove excess electrophoretic material therefrom. The method is particularly applicable to methods of electrophoretic coating wherein the interior surface of an electrically conductive workpiece has been electrophoretically coated according to the steps of: establishing the workpiece with one electrical polarity, flowing an electrophoretic material in a linear stream along a longitudinal dimension of the workpiece, inducing an electrical charge of opposite polarity on the electrophoretic material and along the length of the linear stream thereof to effect electrophoretic migration of the electrophoretic material to the workpiece, and moving the workpiece and the charged linear stream of electrophoretic material relative to one another about an axis corresponding to the longitudinal axis of the workpiece, thereby to electrophoretically deposit a coating of the material on the entirety of the workpiece interior surface.

In carrying out the improved method of the present invention, the workpiece and the flow of air may be preferably moved relative to one another about an axis fixed with respect to the longitudinal axis of the workpiece, thereby to pass the flow of air over substantially the entirety of the coated surface. At least a portion of the flow of air may be directly impinged upon the stream of electrophoretic material to remove any residual thereof from the workpiece interior surface. The force of the airflow along the surface of the coating must be greater than the cohesive force thereof. The flow of air is preferably applied in the same longitudinal direction with respect to the workpiece as a direction of flow of the linear stream of electrophoretic material, which is from the closed end of the workpiece to the open end thereof.

The flow of air may be initially directed against the closed end of the workpiece for radial dispersion along the surface of the closed end onto the body portion of the workpiece and along a longitudinal dimension thereof. Alternatively, the flow of air may be directed radially against the body portion of the workpiece near the closed end portion thereof, flowing thereafter longitudinally along a linear dimension of the interior surface of the body portion. In other alternative embodiments, the flow of air along the longitudinal dimension of the workpiece may be confined to the proximate surface of the electrophoretic coating for at least a substantial distance from the closed end of the workpiece. In further alternative embodiments, the flow of air may be initially impinged onto successive circumferences of the body portion during withdrawal of the nozzle from the workpiece to remove any excess of electrophoretic material from the coating.

Apparatus for carrying out the above improved method of the present invention preferably includes an air aperture disposed in the head portion of a nozzle for issuing a flow of air therefrom, an air source for providing the flow of air to the nozzle, and a conduit communicating the air source with the air aperture means. Such apparatus is particularly useable in connection with an apparatus for electrophoretically coating the interior surface of an electrically conductive workpiece which has a selected linear dimension on the body portion thereof and a closed bottom end substantially normal to the selected workpiece linear dimension. Such apparatus includes a nozzle of electrically conductive material having a head portion for disposition near the closed end of the workpiece and having a selected linear dimension corresponding to that of the workpiece and disposable in close proximity thereto. Means are provided for mounting the nozzle in the workpiece in closely spaced proximity to the interior surface thereof and along the selected linear dimension thereof. A reservoir for containing the liquid electrophoretic material and means such as a pump are provided for supplying electrophoretic material under pressure to the nozzle. An electrical circuit is connected between the nozzle and the workpiece for establishing an electrophoretic path therebetween. The workpiece and the nozzle are mounted for relative motion about an axis fixed relative to the workpiece and the nozzle, such relative motion in a direction lateral to the selected linear dimension of the workpiece, whereby the entirety of the workpiece interior surface may be coated with the electrophoretic material.

Preferably, means for the introduction of the nozzle into the workpiece and means for withdrawal of the nozzle therefrom are provided. Control means are also provided for providing controlled flow of electrophoretic material through the discharge orifice during such introduction and for providing a flow of air from the air aperture in the nozzle head portion during such withdrawal.

The above nozzle may include in one preferred embodiment an air barrier disposed near the head portion at the distal end of the nozzle for channeling the flow of air proximate to the surface of the coating to remove the excess electrophoretic material therefrom during the withdrawal of the nozzle from the workpiece. Such an air barrier may comprise an electrically insulative disc having a diameter slightly smaller than that of the workpiece and having a circumferential portion for flow of air therearound and for channeling the air proximate to the surface of the coating. The above nozzle may also preferably contain means for moving the airflow and the workpiece relative to one another about an axis fixed relative to the selected linear dimension of the workpiece, thereby to pass the flow of air substantially over the entirety of the coated surface.

In a yet further embodiment, the air may flow through an electrically insulative annular tube having a diameter slightly smaller than that of the workpiece, and disposable in close proximity to the body portion of the workpiece. Such annular tube has at least one orifice therein for impinging the flow of air radially onto the coated surface thereby to remove excess coating therefrom during withdrawal of the nozzle from the body of the workpiece.

Referring now to the drawing and to FIG. 1 in particular, apparatus 10 is shown for carrying out the electrophoretic coating method of the present invention. A workpiece 12, which may be a cylindrical can body having a closed end 14 and an open end 16 is disposed on a workpiece holder 18, which may be rotatable such as by means of a mandrel 20. Closed end 14 may be contoured in a variety of different ways; that shown in FIG. 1 has a beaded bottom.

A nozzle 22 is inserted into workpiece 12 to supply a flow of electrophoretic material (see arrow A), preferably during such insertion thereof, and to supply a flow of air (see arrow B), preferably during the withdrawal of nozzle 22, to remove excess electrophoretic coating from the interior surface 24 of workpiece 12. A direct current electrical power supply 27, such as a rectifier, is applied to workpiece 12, preferably through an electrically conductive workpiece holder 18 to establish workpiece 12 at one electrical polarity. Power supply 27 is also attached to nozzle 22 to apply an opposite electrical charge to nozzle 22 for inducing a charge of opposite polarity on the electrophoretic coating therebetween. Electrophoretic material 26 is supplied to nozzle 22 from an electrophoretic material reservoir 28 which may include a chiller 30 and a filter 32. Electrophoretic material 26 is drawn from reservoir 28 through a snorkel 34 and is supplied to nozzle 22 under pressure by means of a pump 36.

In one preferred embodiment, while electrophoretic material 26 is being pumped from the nozzle discharge orifice 37 in a linear stream onto a linear dimension 38 of workpiece 12, nozzle 22 is being inserted into workpiece 12. During that insertion and afterwards, relative movement is supplied between workpiece 12 and the charged linear stream of the electrophoretic material (See arrow A) about an axis corresponding to the longitudinal axis of workpiece 12, thereby to flow electrophoretic material 26 over the entirety of interior surface 24 of workpiece 12. Thereafter, a flow of air is supplied to the entirety of interior workpiece surface 24. Preferably, such relative rotational movement is continued and a flow of air (See arrow B) is supplied from an air source means 40, such as a compressor for example, to an air conduit 60 for communication with the air aperture 43.

Figure 2:
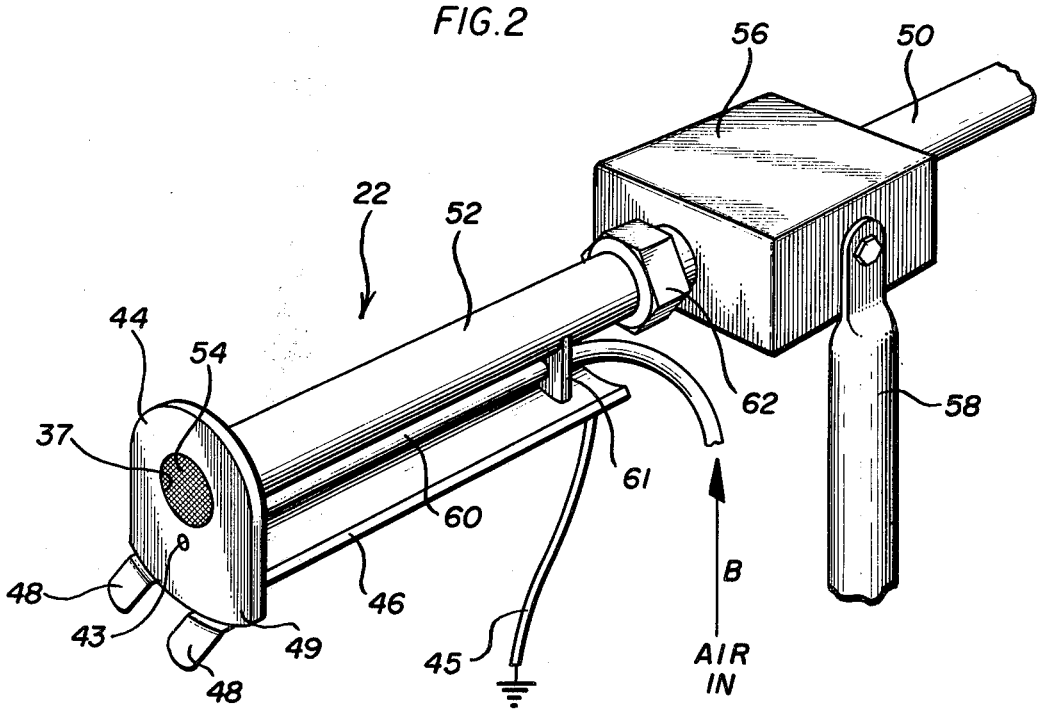
FIG. 2 is an enlarged perspective view of one embodiment of a nozzle apparatus suitable for carrying out the improved method of the present invention, and includes an electrically conductive nozzle head portion disposed substantially normal to an electrically conductive linear portion extending along the length thereof and having a discharge orifice for the coating material in the head portion of the nozzle, the head portion also containing an air aperture for directing a flow of air onto the electrophoretically coated interior surface of a workpiece, the head portion of the nozzle also having tines for extending into the contoured portion of a workpiece bottom, for directing the flow of electrophoretic material thereto and for achieving uniformity of electrophoresis between such tines and the contoured portions of the workpiece.
Figure 3:
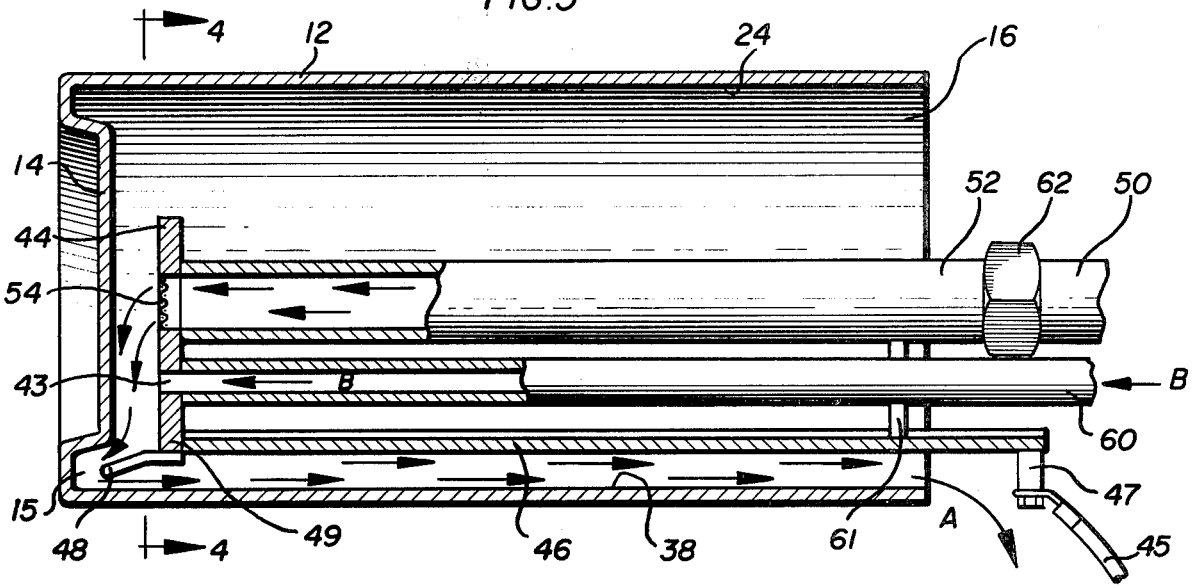
FIG. 3 is an enlarged side view, partially in cross section, of the nozzle of FIG. 2 shown inserted into a workpiece, with arrows showing the flow of electrophoretic material through a mesh screen disposed in the material discharge orifice of the head portion, around the nozzle tines, into the contoured bottom portion of the workpiece, along a linear dimension of the body portion of the workpiece, and out the open end thereof.
Figure 4:
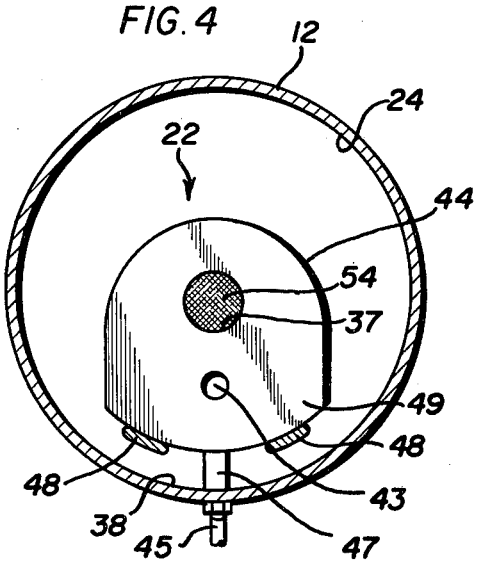
FIG. 4 is an end view taken along line 4—4 of FIG. 3, showing the head portion of the nozzle containing the screened discharge orifice and an airflow aperture therein, the tines projecting from the peripheral surface of the nozzle head portion, and the electrical terminal connection to the linear portion of the nozzle.

Referring now to FIGS. 2, 3 and 4, which show a preferred embodiment of apparatus for carrying out the improved method of the present invention, the nozzle thereof, generally 22, comprises preferably a head portion 44 for disposition near the closed end 14 of workpiece 12 and has a linear portion 46 disposed substantially normal thereto corresponding to selected linear dimension 38 of workpiece 12. Both head portion 44 and nozzle linear portion 46 are made of electrically conductive material. An electrical charge is applied to nozzle linear portion 46 and thereby to connected head portion 44 by means of nozzle wire 45 connected at nozzle electrical terminal 47. Nozzle 22 further comprises tines 48 projecting from a peripheral surface 49 of head portion 44 for guiding the electrophoretic material into contoured portions 15 of closed end 14 of workpiece 12 and for supplying an electrical charge for uniformity of electrophoresis at such contoured portions 15. Electrophoretic material (See arrrow A in FIG. 3) is supplied to nozzle 22 through tube 50 and to head portion 44 through connected electrically insulative material tube 52, which terminates at discharge orifice 37 in head portion 44 of the nozzle 22. A mesh screen 54 covers orifice 37, is preferably made of electrically conductive material, and serves to create laminar flow from orifice 37. Nozzle 22 is supported by a nozzle support 56 which is adjustable at support arm 58 for changing the angle between nozzle 22 and the longitudinal axis of workpiece 12. The flow of air (See arrow B in FIG. 3) for removing excess electrophoretic material is supplied through air aperture 43 disposed in head portion 44 of nozzle 22 through an air conduit 60 which is preferably made of an electrically insulative material. Air conduit 60, nozzle linear portion 46 and material tube 52 are interconnected at the proximal end of nozzle 22 by a nozzle support brace 61. Nozzle 22 may be disconnected at coupling 62 for changing from one nozzle configuration to another, such as for example for coating workpieces having differently contoured bottom ends.

Figure 5:
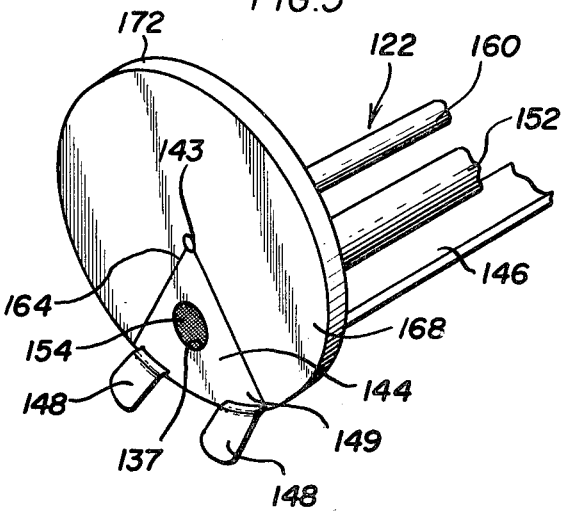
FIG. 5 is a perspective view of an alternative embodiment of the apparatus for carrying out the improved method of the present invention, showing a section-shaped nozzle head portion containing an electrophoretic material discharge orifice and airflow aperture therein, a linear portion disposed substantially normal to the head portion of the nozzle, tines projecting from the peripheral surface of the nozzle head portion, and further showing a discshaped barrier means having a diameter slightly less than that of the workpiece for confining the flow of air to the proximate surface of the electrophoretic coating.
Figure 6:
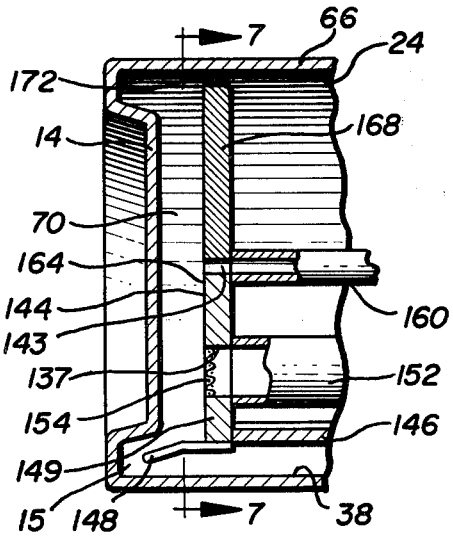
FIG. 6 is an enlarged fragmented side view, partially in cross section, showing the nozzle of FIG. 5 disposed within a workpiece.
Figure 7:
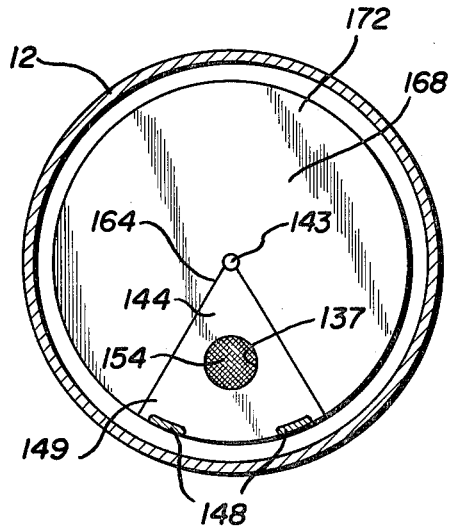
FIG. 7 is an end view taken along line 7—7 of FIG. 6, showing the section-shaped head portion of the nozzle having an electrophoretic material discharge orifice therein, an airflow opening therein, and tines projecting from the periphery thereof and disposable in close proximity to the contoured closed bottom portion of the workpiece.

Referring now to FIGS. 5, 6 and 7, wherein an alternative embodiment of apparatus for carrying out the improved method of the present invention is shown, nozzle 122 comprises a section-shaped head portion 144 disposed substantially normal to a linear portion 146, and includes tines 148 projecting from the radial portion 149 of head portion 144. Electrophoretic material is supplied through an electrically insulative material tube 152 to a material discharge orifice 137 located in head portion 144 of nozzle 122 and through an electrically conductive mesh screen 154 disposed thereover.

Air is supplied by means of an air conduit tube 160 to an air aperture 143 located near the apex 164 of section-shape head portion 144. Such disposition of air aperture 143 serves to center the flow of air therefrom with respect to the body portion 66 of workpiece 12. An electrically insulative air barrier, preferably in the form of a disc 168, is carried by nozzle 122 and is disposed near section-shaped head portion 144 thereof for channeling the flow of air proximate to the surface of the coating for removing excess electrophoretic material therefrom during withdrawal from nozzle 122 from workpiece 12. The central disposition of air aperture 143 with respect to the electrically insulative air barrier disc 168 creates substantial uniformity of flow of air over the surface of the coating during withdrawal of nozzle 122 from workpiece 12. Accordingly, a head of air of greater than atmospheric pressure is created within workpiece 12 at chamber 70, and flows over the circumferential portion 172 of disc 168 for channeling air proximate to the surface of the coating to remove excess electrophoretic material therefrom.

Figure 8:
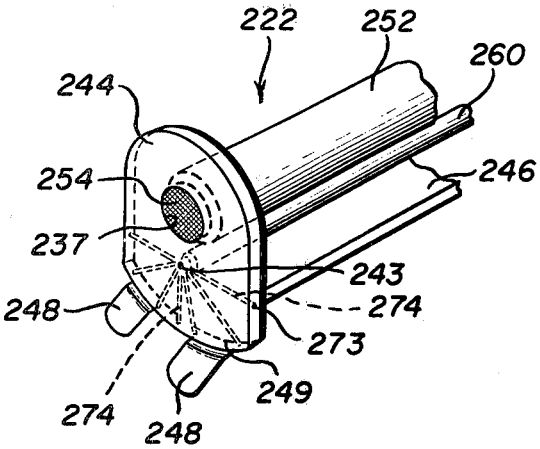
FIG. 8 is a perspective view of a further alternative embodiment of the apparatus suitable for carrying out the improved method of the present invention, showing a plurality of airflow apertures disposed in the head portion of the nozzle for directing a plurality of airflows laterally onto the body portion of the workpiece interior surface.
Figure 9:
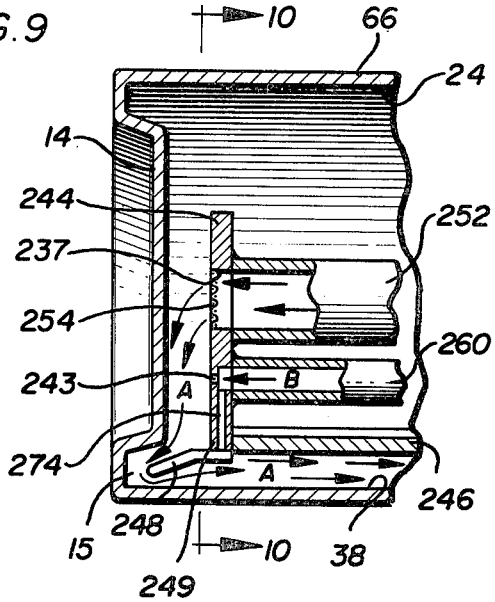
FIG. 9 is an enlarged fragmented side view, partially in cross section, showing the nozzle of FIG. 8 inserted within a workpiece having a contoured closed end portion.
Figure 10:
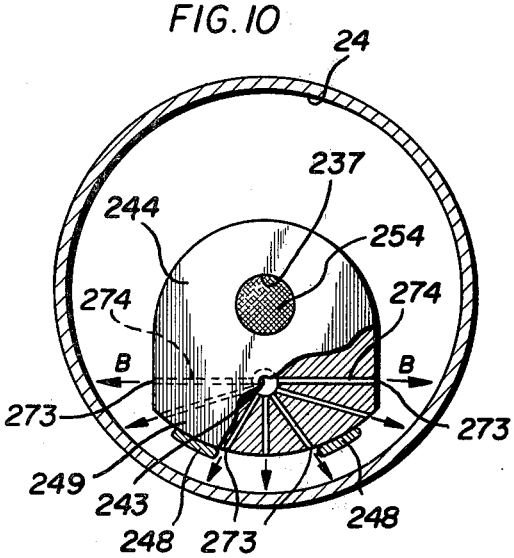
FIG. 10 is an end view taken along line 10—10 of FIG. 9, showing a screened electrophoretic material discharge orifice in the head portion of the nozzle, and the plurality of airflow apertures for directing a plurality of airflows onto a coated interior workpiece surface, and further showing tines extending from the periphery of the head portion of the nozzle.

Referring now to FIGS. 8, 9 and 10, wherein a further alternative embodiment of apparatus for carrying out the improved method of the present invention is shown, nozzle 222 includes an electrically conductive head portion 244 and a linear portion 246 disposed substantially normal thereto. Head portion 244 includes electrically conductive tines 248 projecting from periphery 249 of head portion 244. Electrophoretic material is supplied through an electrically insulative material tube 252 to nozzle 222 and flows through an electrically conductive grid 254 disposed over the electrophoretic material discharge orifice 237 (See arrow A in FIG. 9). A flow of air is supplied through an air conduit 260 to nozzle head portion 244, where the flow of air is directed to and through opening 243 and through a plurality of openings 273 in nozzle head portion 244. Air openings 273 are disposed for directing at least a portion of the air laterally onto interior surface 24 of body portion 66 of workpiece 12 and are supplied with air through a corresponding plurality of radial air conduits 274, which are disposed in head portion 244 substantially normal to the principal air conduit 260. Radial air conduits 274 may be of different sizes to determine the volume of air flowing through each. For example, the main air aperture 243 for impinging the flow of air directly onto the closed end 14 of workpiece 12 may be larger in diameter than the diameters of radial air conduits 274 for directing the major portion of air onto the workpiece closed end 14. Alternatively, the principal air aperture 243 may be smaller in diameter than those of radial air conduits 274 to direct a greater portion of the airflow radially and laterally for impingement upon body portion 66 of workpiece 12. In any event, the aperture 243 is restricted relative to the diameter of conduit 260 to force a portion of the airflow to conduits 274. Alternatively, of course, aperture 243 may be dispensed with, so that air is directed solely through apertures 273.

Figure 11:
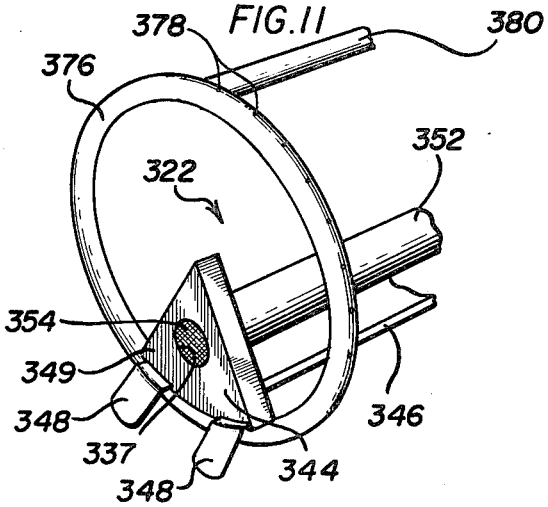
FIG. 11 is an enlarged fragmented perspective view of a yet further alternative embodiment of a nozzle for carrying out the improved method of the present invention, showing an annular electrically insulative tube having a diameter slightly smaller than that of the workpiece and having a plurality of orifices therein for impinging the flow of air onto the coated workpiece surface.
Figure 12:
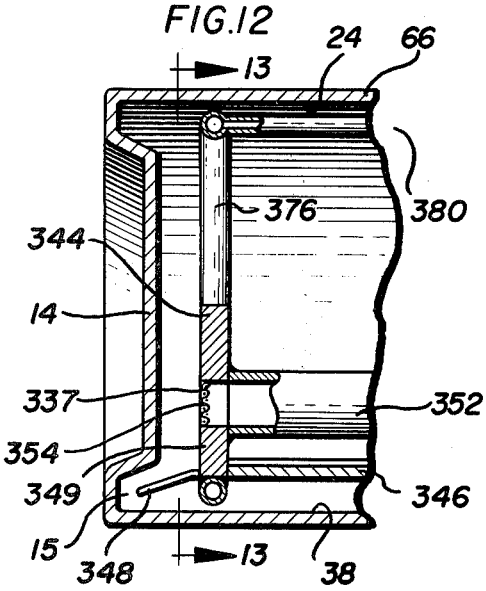
FIG. 12 is an enlarged fragmented side view of the nozzle of FIG. 11 shown inserted into a workpiece.
Figure 13:
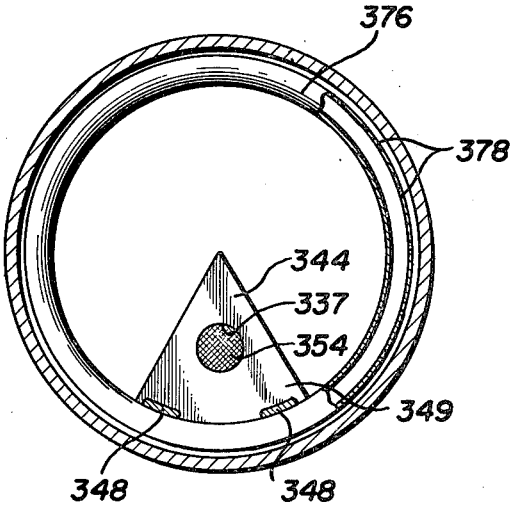
FIG. 13 is an end view taken along line 13—13 of FIG. 12.

Referrng now to FIGS. 11, 12 and 13, wherein a yet further alternative embodiment of apparatus for carrying out the improved method of the present invention is shown, nozzle 322 has head portion 344, normally disposed linear portion 346, tines 345, and electrophoretic material tube 352. The flow of air is, however, supplied to interior surface 24 of body portion 66 of workpiece 12 through an electrically insulative annular tube 376 having a diameter slightly smaller than that of workpiece 12 and impinges upon interior surface 24 through a plurality of orifices 378 to remove excess electrophoretic material therefrom preferably during withdrawal of nozzle 322 from workpiece 12. Annular tube 376 is supplied with the flow of air through an air conduit 380.

The workpiece may in general be of any size or shape as long as the nozzle may be disposed in close proximity thereto. However, the improved apparatus and method of the present invention have been particularly suitable for use in connection with workpieces which are steel or aluminum beverage cans, having a beaded or domed closed bottom end. The materials used for the electrically conductive portions of the nozzle, such as the head portion, the linear portion, the tines, the mesh screen, and nozzle electrical terminal, may in general be formed from any metal, although aluminum and stainless steel have been particularly suitable. Electrically insulative nozzle portions, such as the material tube, the air conduit, the barrier, the nozzle support brace and the annular tube, may be formed for example from a plastic material, such as for example, polyethylene.

It is readily apparent from the skeleton structures shown herein of conductive and nonconductive materials that a nozzle might be drilled and bored from a solid piece of conductive material for example and selectively insulated in its exterior surfaces to accomplish the same function as the skeleton structures. Also, the nozzle could be drilled and bored from a solid piece of nonconductive material and made selectively conductive on its exterior and/or interior orifices to accomplish the same functions as described above.

The basic and novel characteristics of the improved method and apparatus of the present invention and the advantages thereof will be readily understood by those skilled in the art from the foregoing disclosure. It will become readily apparent that various changes and modifications may be made in the form, construction and arrangement of the improved method and apparatus set forth hereinabove without departing from the spirit and scope of the invention. Accordingly, the preferred and alternative embodiments of the present invention set forth hereinabove are not intended to limit such spirit and scope in any way.

What is claimed is:

1. A method for electrophoretically coating the interior surface of an electrically conductive workpiece having a longitudinal axis and a longitudinal dimension and having a body portion closed at one end and open at the opposite end, said method comprising the steps of:

establishing the workpiece at one electrical polarity;

flowing an electrophoretic material in a linear stream along the longitudinal dimension of the workpiece;

inducing an electrical charge of opposite polarity on the electrophoretic material and along the length of the linear stream thereof to effect electrophoretic migration of the electrophoretic material to the workpiece;

moving the workpiece and the charged linear stream of electrophoretic material relative to one another about an axis corresponding to the longitudinal axis of the workpiece thereby to electrophoretically deposit a coating of the material over the entirety of the workpiece interior surface; and providing a flow of air over the entirety of the electrophoretic coating to remove excess electrophoretic material therefrom.

2. The improved method of claim 1 wherein the flow of air is along the longitudinal dimension of the workpiece and from the closed end to the open end thereof.

3. The improved method of claim 2 wherein the workpiece and the flow of air are moved relative to one another about an axis fixed with respect to the longitudinal axis of the workpiece thereby to pass the flow of air over substantially the entirety of the coated surface.

4. The improved method of claim 3 wherein the force of the airflow along the surface of the coating is greater than the cohesive force thereof, whereby excess material is displaced from the coated surface and moved in the direction of the airflow.

5. The improved method of claim 1 wherein the flow of air is directed initially against the closed end of the workpiece and is radially dispersed along the surface of the closed end and to the body portion of the workpiece and along the longitudinal dimension thereof.

6. The improved method of claim 1 wherein the flow of air is directed radially against the body portion of the workpiece substantially at said closed end and flows thereafter longitudinally of the interior surface of the body portion.

7. The improved method of claim 1 wherein the flow of air is initially impinged onto a circumference of the coated interior surface of the workpiece body portion near the closed end thereof and is successively impinged upon circumferences of the body portion in the direction of the longitudinal axis toward the open end to remove excess electrophoretic material from the coating along the entirety of the workpiece body portion.

8. In an apparatus for electrophoretically coating the interior surface of an electrically conductive workpiece having a selected linear dimension on the body portion thereof and a closed end substantially normal to the selected linear dimension, which apparatus includes a nozzle of electrically conductive material having a head portion for disposition near the closed end of the workpiece and having a selected linear dimension corresponding to that of the workpiece, means for mounting the nozzle in the workpiece in closely spaced proximity to the interior surface thereof and along the selected linear dimension thereof, a reservoir for containing a liquid electrophoretic material, means for supplying electrophoretic material under pressure to the nozzle for discharge from an orifice therein, an electrical circuit connected between the nozzle and workpiece for establishing an electrophoretic path therebetween, and means for moving the workpiece and the nozzle relative to one another about an axis fixed relative to the workpiece and the nozzle and in a direction lateral to the selected linear dimension of the workpiece, whereby the entirety of the workpiece interior surface is coated with the electrophoretic material, the improvement comprising:

airflow means carried by said nozzle to provide a flow of air to the coated interior surface of the workpiece for removing excess electrophoretic material therefrom.

9. The improvement of claim 8 wherein said airflow means comprises air aperture means disposed on the head portion of said nozzle for issuing the flow of air therefrom, air source means for providing the flow of air to said nozzle, and air conduit means connecting said aperture means and said air source means.

10. The improvement of claim 9 wherein said air aperture means is disposed for initially impinging at least a portion of the flow of air onto the closed end of the workpiece.

11. The improvement of claim 9 wherein said air aperture means comprises a plurality of openings on the nozzle head portion which are disposed for directing at least a portion of the flow of air radially onto the interior surface of the body portion of the workpiece.

12. The improvement of claim 8 further comprising electrically insulative air barrier means carried by the nozzle and disposed near the head portion thereof for channeling the flow of air proximate to the surface of the coating for removing excess electrophoretic material therefrom during the withdrawal of the nozzle from the workpiece.

13. The improvement of claim 12 wherein said air barrier means comprises a disc of a diameter slightly smaller than that of the workpiece and having a circumferential portion, whereby the air flows from the circumferential portion of said disc and onto the surface of the coating.

14. The improvement of claim 8 further comprising means for flowing at least a portion of the air in the same longitudinal direction with respect to the workpiece as the direction of flow of the linear stream of electrophoretic material.

15. The improvement of claim 8 further comprising means for moving the flow of air and the workpiece relative to one another about an axis fixed relative to the linear dimension of the workpiece and in a direction lateral to the linear stream of electrophoretic material, thereby to pass the flow of air over substantially the entirety of the coated surface.

16. The improvement of claim 8 wherein said airflow means comprises an electrically insulative annular tube having a diameter slightly smaller than that of the workpiece and having at least one orifice therein for impinging the flow of air radially with respect to the longitudinal axis of the workpiece and onto the coated surface to remove excess electrophoretic material therefrom.

17. A method for electrophoretically coating the interior surface of an electrically conductive workpiece having a body portion closed at one end and open at the opposite end, such method comprising the steps of:

establishing the workpiece at one electrical polarity;

flowing an electrophoretic material onto the interior surface and the closed end body portion of the workpiece;

inducing an electrical charge of opposite polarity on the electrophoretic material to effect electrophoretic migration of the electrophoretic material to the workpiece;

moving the workpiece and the charged electrophoretic material relative to one another thereby to assure electrophoretic deposition of a coating of the material over the entirety of the workpiece interior surface, including the closed end and body portion; and providing a flow of air over the entirety of the electrophoretic coating without rinsing in any liquid to remove excess electrophoretic material therefrom.

* * * * *